United States Patent [19]

Monroe et al.

[11] Patent Number: 4,911,442

[45] Date of Patent: Mar. 27, 1990

[54] TENNIS GUIDE TRAINING TARGET

[76] Inventors: Kevin Monroe, 471 Harts Bridge Rd.; Robert Briley, 155 Oak Grove Rd., both of Jackson, Tenn. 38301

[21] Appl. No.: 198,007

[22] Filed: May 24, 1988

[51] Int. Cl.[4] ..... A63B 61/00

[52] U.S. Cl. ..... 273/29 A

[58] Field of Search ..... 273/29 A, 30, 26 R, 273/407

[56] References Cited

U.S. PATENT DOCUMENTS

| | | | |
|---|---|---|---|
| 2,964,316 | 12/1960 | Rose | 273/26 R |
| 3,858,878 | 1/1975 | Tassone | 273/26 R |
| 3,993,306 | 11/1976 | Scott . | |
| 4,160,549 | 7/1979 | Simpson . | |
| 4,204,679 | 5/1980 | Kreuzman . | |
| 4,231,572 | 11/1980 | Thornton | 273/29 A |
| 4,243,221 | 1/1981 | Ferreira-Godinko . | |
| 4,696,471 | 9/1987 | McGrath et al. | 273/29 A |

FOREIGN PATENT DOCUMENTS

| | | | |
|---|---|---|---|
| 2226599 | 1/1973 | Fed. Rep. of Germany | 273/29 A |
| 204863 | 9/1923 | United Kingdom | 273/30 |

*Primary Examiner*—T. Brown

*Attorney, Agent, or Firm*—Jerry T. Kearns

[57] ABSTRACT

A tennis guide training device utilizes an actual size tennis ball which is secured to an axially adjustable elongated mounting stem. The mounting stem is adjustably secured to a clamping device which is adapted for engagement with the top edge of a conventional tennis net. In a first embodiment, the clamping device is in the form of a resilient spring clip which is provided with a threaded mounting socket. The adjustable stem is formed from a coil spring which is received within the threaded socket. The height of the tennis ball target above the top net edge may be adjusted by screwing the mounting stem into or out of the threaded socket. In a second embodiment, the clamping device is in the form of a resilient clip which is provided with a mounting socket having an axial bore for the reception of a mounting stem. The mounting stem is formed from a cylindrical rod of a rigid material and is secured in adjusted axial position within the mounting socket by a thumb screw. The device serves as a training aide to enable practicing tennis players to develop a better union of visual and motor skills.

2 Claims, 2 Drawing Sheets

FIG 2
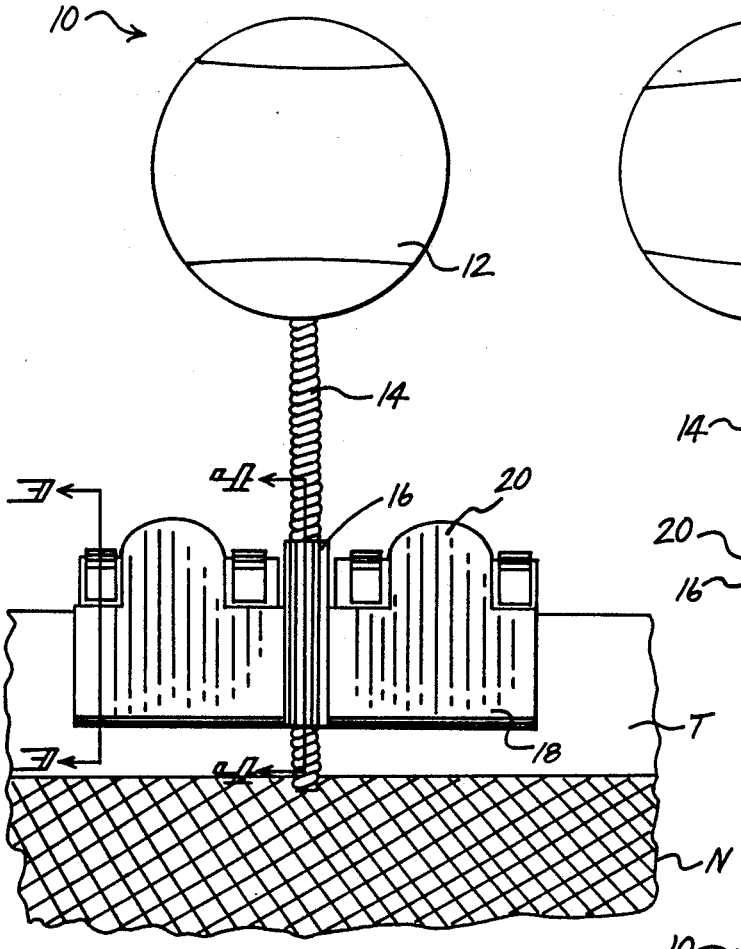
FIG 1
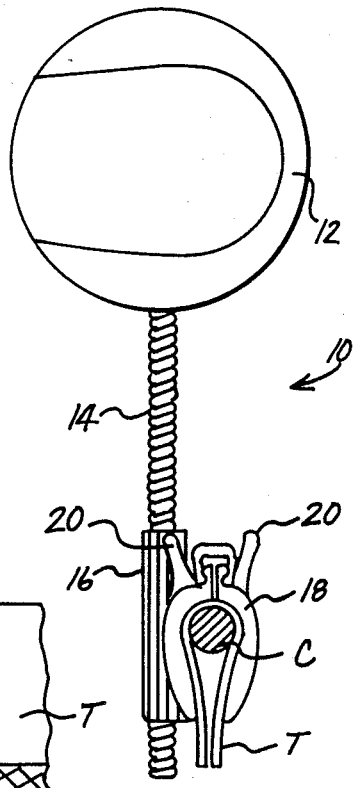
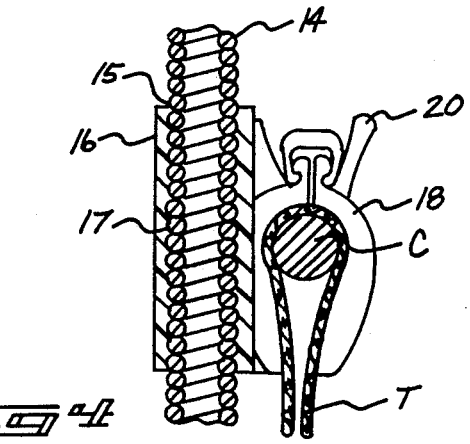
FIG 4
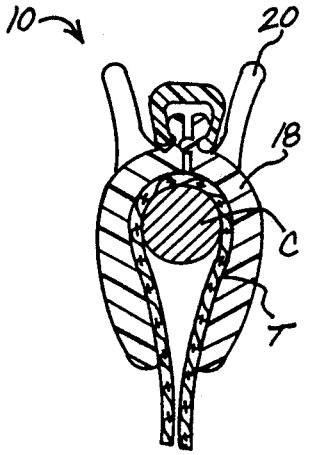
FIG 3

TENNIS GUIDE TRAINING TARGET

BACKGROUND OF THE INVENTION

1. Field of the Invention

The present invention relates to tennis training devices, and more particularly pertains to a new and improved tennis guide training device for enabling practicing tennis players to develop a better union of visual and motor skills. Many novice tennis players beginning to learn the sport think that an oversized racket will provide them with instant tennis skills. However, after a short period, the neophyte player realizes that the oversized racket is of little help and they convince themselves that they were never meant to play tennis and then quit the sport. The more people who become depressed with the game of tennis, the more the tennis industry suffers. As a partial remedy, the present invention provides a training device which facilitates the rapid increase in skill level of beginning tennis players. Perceptual literature will verify that as the visual and motor skills of an individual are coordinated, the skill in the activity in which the individual is engaged increases. In order to implement these perceptual training theories in the field of tennis, it is necessary that a player repeatedly visualize the tennis ball passing over a designated area of the net. The more frequently a player visualizes the correct passage of the tennis ball over the top of the net, the easier the player will find it to achieve the motor skills necessary to replicate the desired visual results. To be able to consistently hit the ball over a certain region of the net, the player's brain must have a target. Once the brain registers the target, it can mentally select from the player's remembered repertoire of strokes to pick the best stroke to enable placing the ball over the desired region of the net, in any given circumstance. In order to achieve these advantages, the present invention provides a tennis guide training device which utilizes an actual size tennis ball as a visual target.

DESCRIPTION OF THE PRIOR ART

Various types of tennis training devices are known in the prior art. A typical example of such a training device is to be found in U.S. Pat. No. 3,993,306, which issued to S. Scott on Nov. 23, 1976. This patent discloses a low cost net mounted tennis target structure for enabling individuals to improve their tennis skills on an otherwise unmodified regulation tennis court. The target structure includes an elongated vertically adjustable strip adapted to be mounted above a tennis net to define a ball-clearing opening with depending laterally adjustable strips which define target areas such that tennis balls propelled through the target areas land in a designated area within the confines of the court. U.S. Pat. No. 4,160,549, which issued to J. Simpson on Jul. 10, 1979, discloses an adjustable target for practicing tennis serves on a regulation sized tennis court. The target comprises a substantially rectangular frame defining an enclosure through which the tennis balls may pass. The frame includes two mutually slidable U-shaped side members. The upper leg of each side member is slidable in an upper telescoping member and the lower leg of each side member is slidable in a lower telescoping member having a downwardly extending adjustable leg telescoped within a main upright support. A removable net may be attached to the frame for catching and holding the served tennis balls penetrating the frame opening. U.S. Pat. No. 4,204,679, which issued to H. Kreuzman on May 27, 1980, discloses a tennis practice serving net which utilizes a pair of upright posts anchored adjacent ends of a conventional tennis net. An elongated rectangular practice serving net overlies, and is coplanar with the conventional tennis net. The serving net is cut away to define an elongated rectangular opening above the court net adjacent the fair service areas. An upright divider post is arranged at a midpoint of the practice serving net and divides the rectangular opening into a pair of rectangular openings. A variety of adjustable mounting mechanisms are disclosed for determining the height of the practice serving net above the conventional tennis net. U.S. Pat. No. 4,231,572, which issued to W. Thornton on Nov. 4, 1980, discloses a tennis target for practicing tennis skills which includes a frame having an opening through which a tennis ball may be driven by a player. The frame is adapted to be detachably mounted in an upright position on a conventional tennis net so as to extend upwardly from the upper edge of the net. The frame includes a pair of downwardly depending laterally spaced posts which are arranged to be interwoven within the meshes of the net. The target frame is spring mounted on the posts for yieldingly urging the frame into an upright position so that when struck by tennis ball, the force of the ball is absorbed by pivotal movement of the frame against the urging force of the springs. U.S. Pat. No. 4,243,221, which issued to M. Ferreira-Godinho on Jan. 6, 1981, discloses a training device for practicing tennis serves. The device utilizes a practice net which is erected above and in the same vertical plane as the conventional tennis net.

While the above mentioned devices are suited for their intended usage, none of these devices provide a tennis guide training device which utilizes an actual sized tennis ball target mounted by an adjustable mounting stem to a clamping device for securement of the top edge of a conventional tennis net. Inasmuch as the art is relatively crowded with respect to these various types of tennis training devices, it can be appreciated that there is a continuing need for and interest in improvements to such tennis training devices, and in this respect, the present invention addresses this need and interest.

SUMMARY OF THE INVENTION

In view of the foregoing disadvantages inherent in the known types of tennis training devices now present in the prior art, the present invention provides an improved tennis guide training device. As such, the general purpose of the present invention, which will be described subsequently in greater detail, is to provide a new and improved tennis guide training device which has all the advantages of the prior art tennis training devices and none of the disadvantages.

To attain this, representative embodiments of the concepts of the present invention are illustrated in the drawing and make use of an actual size tennis ball which is secured to an axially adjustable elongated mounting stem. The mounting stem is adjustably secured to a clamping device which is adapted for engagement with the top edge of a conventional tennis net. In a first embodiment, the clamping device is in the form of a resilient spring clip which is provided with a threaded mounting socket. The adjustable stem is formed from a coil spring which is received within the threaded socket. The height of the tennis ball target above the top net edge may be adjusted by screwing the mounting stem into or out of the threaded socket. In a second embodiment, the clamping device is in the form of a resilient clip which is provided with a mounting socket having an axial bore for the reception of a mounting stem. The mounting stem is formed from a cylindrical rod of a rigid material and is secured in adjusted axial position within the mounting socket by a thumb screw. The device serves as a training aide to enable practicing tennis players to develop a better union of visual and motor skills.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded a including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tennis guide training device which has all the advantages of the prior art tennis training devices and none of the disadvantages.

It is another object of the present invention to provide a new and improved tennis guide training device which may be easily and efficiently manufactured and marketed.

It is a further object of the preset invention to provide a new and improved tennis guide training device which is of a durable and reliable construction.

An even further object of the present invention is to provide a new and improved tennis guide training device which is susceptible of a low cost of manufacture with regard to both materials and labor, and which accordingly is then susceptible of low prices of sale to the consuming public, thereby making such tennis training devices economically available to the buying public.

Still yet another object of the present invention is to provide a new and improved tennis guide training device which provides in the apparatuses and methods of the prior art some of the advantages thereof, while simultaneously overcoming some of the disadvantages normally associated therewith.

Still another object of the present invention is to provide a new and improved tennis guide training device for enabling beginning tennis players to assimilate the necessary visual perceptual and motor skills.

Yet another object of the present invention is to provide a new and improved tennis guide training device which utilizes an actual sized tennis ball target adapted for securement at an adjustable height above the top edge of a conventional tennis net.

Even still another object of the present invention is to provide a new and improved tennis guide training device which utilizes an actual sized tennis ball target secured to an axially adjustable mounting stem provided with a clamping device adapted to be detachably secured to the top edge of a conventional tennis net.

These together with other objects of the invention, along with the various features of novelty which characterize the invention, are pointed out with particularity in the claims annexed to an forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of the tennis guide training device according to the first embodiment of the present invention.

FIG. 2 is a front view of the tennis guide training device according to the first embodiment of the present invention.

FIG. 3 is a transverse cross sectional view, taken along line 3—3 of FIG. 2, illustrating the mounting of the clamping device according to the first embodiment of the present invention on a conventional tennis net.

FIG. 4 is a transverse cross sectional view, taken along line 4—4 of FIG. 2, illustrating the engagement of the adjustable mounting stem according to tee first embodiment of the present invention within the clamp mounting socket.

DESCRIPTION OF THE PREFERRED EMBODIMENT

Figure 7:
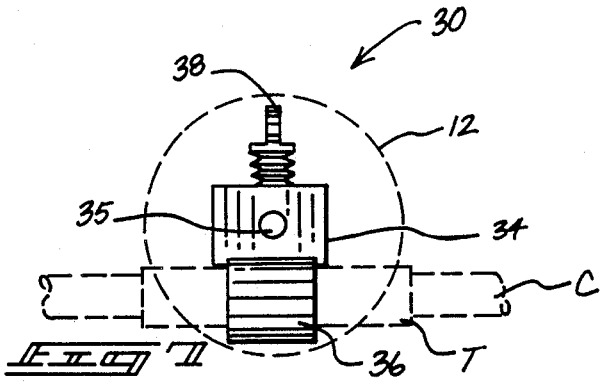
FIG. 7 is a top view of the tennis guide training device according to the second embodiment of the present invention, with the mounting stem and tennis ball target removed. The orientation of the tennis ball target with respect to the illustrated structure is depicted in phantom line.

With reference now to the drawings, and in particular to FIG. 1 thereof, a new and improved tennis guide training device embodying the principles and concepts of the present invention and generally designated by the reference numeral 10 will be described.

More specifically, it will be noted that the first embodiment 10 of the invention includes a regulation sized tennis ball (Official U.S. Lawn Tennis Association tennis ball) 12 secured to one end of an elongated mounting stem 14. The mounting stem 14 is formed from a helically wound coil spring. The stem 14 is received for axial adjustment within a cylindrical socket 16. The socket 16 is rigidly secured to a clamp 18. The clamp 18 is adapted for detachable engagement with the cable C and tape T which extend along the top edge of a conventional tennis net. The clamp 18 is of the resilient spring type and may be released by pressing the clamp ears 20 together.

In FIG. 2, a front view is provided which illustrates the relative locations of the socket 16, clamp 18, mounting stem 14 and target 12. As previously described, the spring type clamp 18 is adapted for detachable engagement with the tape T which extends horizontally along the top edge of a conventional tennis net N. Thus, the adjustable mounting stem 14 serves to adjustably position the target 12 at a selected height above the top edge of the net N.

FIG. 3 provides a cross sectional view which illustrates the manner of engagement of the clamp 18 over the tape T and suspension cable C of a conventional tennis net.

As shown in FIG. 4, the cylindrical mounting socket 16 is provided with a cylindrical bore 15 which is provided with a helical thread 17 having a circular cross sectional shape for cooperation with the helically wound coil spring mounting stem 14. The spring construction of the mounting stem 14 provides a shock absorbent mounting for the target 12 and serves to absorb the force of an impact between a struck tennis ball and the target 12. This force might otherwise be transferred to the clamp 18 and cause disengagement of the clamp 18 from the tennis net Because of the threaded engagement between the socket 16 and the mounting stem 14, the height of the target 12 above the top horizontal edge of the net may be easily adjusted by screwing the mounting stem 14 into or out of the threads 17 of the socket 16. This allows players of progressively increasing skill levels to lower the height of the target 12 above the top edge of the net as their skills increase.

Figure 5:
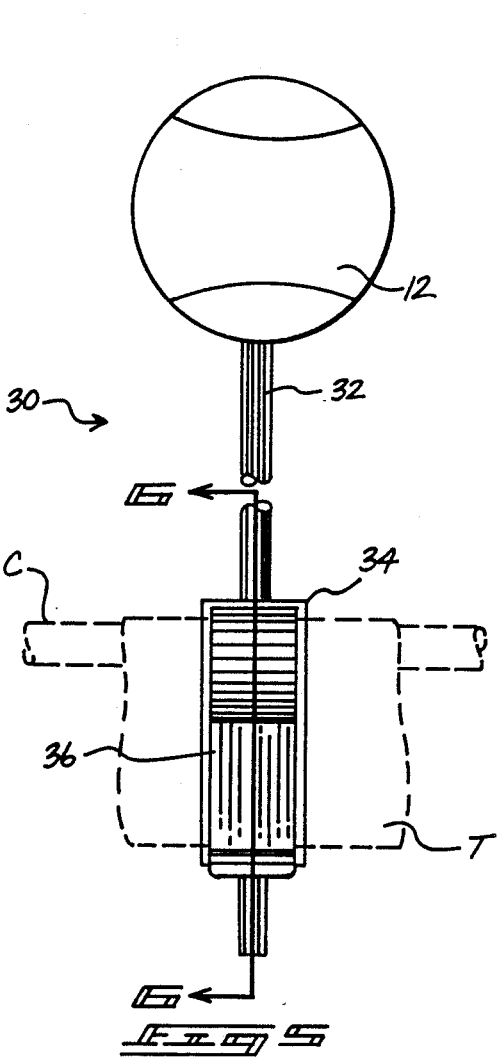
FIG. 5 is a front view illustration the tennis guide device according to a second embodiment of the present invention.

With reference now to FIG. 5, a second embodiment 30 of the present invention will now be described. The second embodiment 30 utilizes a regulation sized tennis ball target 12 which is secured to a rigid cylindrical mounting stem 32. The mounting stem 32 is received within a mounting socket 34 which is attached to a resilient U-shaped clamp 36. The resilient clamp 36 is adapted for detachable securement over the top horizontal edge of a conventional tennis net which includes a suspension cable C enclosed within an edge tape T.

Figure 6:
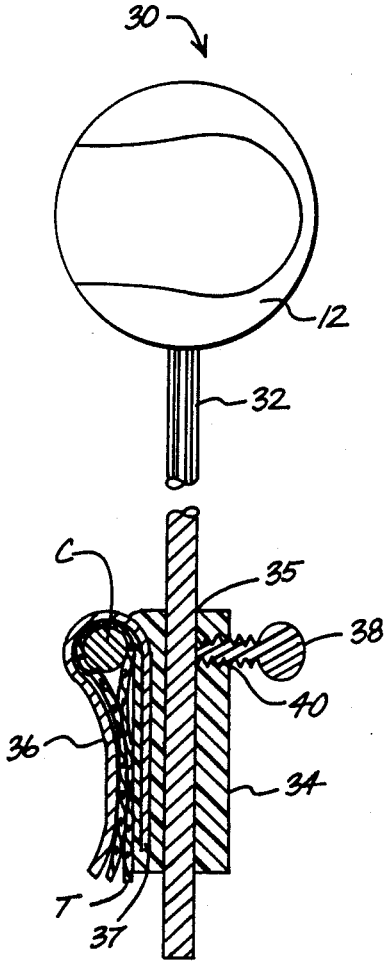
FIG. 6 s a cross sectional view, taken along line 6–6 of FIG. 5, illustrating the constructional details of the tennis guide device according to the second embodiment of the present invention.

As shown in FIG. 6, the U-shaped clamp 36 has one leg 37 embedded within the mounting socket 34. The socket 34 is preferably formed from a molded plastic material and the clamp 36 may be formed from a thin sheet metal material. A cylindrical bore 35 extends axially through the mounting socket 34 and is adapted for the reception of the rigid cylindrical mounting stem 32. The mounting stem 32 may be secured in a selected axially adjusted position by manual engagement of a thumb crew 38 which is received within a threaded bore 40 formed transversely in the socket 34. Thus, a player may adjustably position the target 12 at a desired elevation above the top horizontal edge of a tennis net.

FIG. 7 provides a top view of the tennis guide device 30 according to the second embodiment of the present invention, with the target 12 and attached mounting stem 32 removed from the mounting socket 34. The relative orientation of the target 12 in an assembled condition is illustrated in phantom lines.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tennis guide training device, comprising:

a target having the actual size and shape of an official U.S. Lawn Tennis Association tennis ball;

a cylindrical mounting socket having an axially extending cylindrical bore provided with a helical groove having a circular cross sectional shape;

an elongated mounting stem formed by a helically wound coil spring having an upper end secured to said tennis ball target, said stem being in threaded engagement within said mounting socket;

and a spring clamp secured to said mounting socket in a laterally offset orientation to allow said mounting stem to extend above and below said clamp, said clamp dimensioned for frictional engagement with a horizontal top edge of a tennis net for adjustably securing said tennis ball target above a tennis net.

2. A tennis guide training device, comprising:

a target having the actual size and shape of an official U.S. Lawn Tennis Association tennis ball;

a cylindrical mounting socket having an axially extending cylindrical bore;

an elongated mounting stem formed by a cylindrical rod having an upper end secured to said tennis ball target, said rod receiving in sliding engagement within said mounting socket;

a thumbscrew extending transversely through said mounting socket for securing said mounting stem in a selected adjusted position;

and a spring clamp secured to said mounting socket in a laterally offset orientation to allow said mounting stem to extend above and below said clamp, said clamp dimensioned for frictional engagement with a horizontal top edge of a tennis net for adjustably securing said tennis ball target above a tennis net.

* * * * *